US009289808B2

(12) United States Patent
De Luca et al.

(10) Patent No.: US 9,289,808 B2
(45) Date of Patent: Mar. 22, 2016

(54) COIL LAYING HEAD

(75) Inventors: Andrea De Luca, Remanzacco (IT); Matteo Nobile, Ruda (IT); Carlo Persello, Moruzzo (IT)

(73) Assignee: Danieli & C. Officine Meccaniche S.P.A., Buttrio (IT)

( * ) Notice: Subject to any disclaimer, the term of this patent is extended or adjusted under 35 U.S.C. 154(b) by 287 days.

(21) Appl. No.: 14/003,205

(22) PCT Filed: Mar. 2, 2012

(86) PCT No.: PCT/EP2012/053606

§ 371 (c)(1), (2), (4) Date: Sep. 4, 2013

(87) PCT Pub. No.: WO2012/119935

PCT Pub. Date: Sep. 13, 2012

(65) Prior Publication Data

US 2013/0334354 A1 Dec. 19, 2013

(30) Foreign Application Priority Data

Mar. 4, 2011 (IT) ..... MI2011A0344

(51) Int. Cl.
*B21C 47/14* (2006.01)

(52) U.S. Cl.
CPC ..... *B21C 47/14* (2013.01); *B21C 47/143* (2013.01)

(58) Field of Classification Search
CPC .... B21C 47/14; B21C 47/143; B21C 47/146; B65H 51/02
See application file for complete search history.

(56) References Cited

U.S. PATENT DOCUMENTS

2007/0090223 A1 4/2007 Shore et al.

FOREIGN PATENT DOCUMENTS

EP 1844869 A1 * 10/2007 ..... B21C 47/143
WO WO2006111382 10/2006
WO WO 2006125793 A1 * 11/2006 ..... B21C 47/14

* cited by examiner

*Primary Examiner* — William E Dondero
(74) *Attorney, Agent, or Firm* — Stetina Brunda Garred & Brucker

(57) ABSTRACT

A coil laying head comprising a rotor (14) having two or more conduits (1'), a selector tube (5) coaxially arranged with respect to the rotor (14) to guide a rolled product into one of the conduits (1'), a main control, connecting means between the main control and the rotor (14) for setting in rotation the rotor (14), a phase shifter system ((6,7,8,8',9,10,11), including two nonmoving components ((10,),(11,)), an input component (7) connected to the main control, an output component (6) connected to the selector tube (5), a first group of side pinions (8') meshed on the input component and on one of the nonmoving components and a second group of side pinions (8) meshing on the output component and on the other nonmoving components, connection means (9) connecting the first group of side pinions with the second group of side pinions to drive this latter in rotation according to the axis (X), angular phase shift adjustment device (12,) between the first and the second nonmoving component.

10 Claims, 7 Drawing Sheets

COIL LAYING HEAD

FIELD OF THE INVENTION

This invention refers to a coil laying head, in particular for a wire rod produced by a hot rolling mill.

STATE OF THE ART

In the state of the art, coil laying machines consist of a rotating coil laying head comprising a tube, terminally conformed in a spiral with a coaxial input axis at the rolling mill axis, basically horizontal, and the output axis at a tangent with the theoretical nominal diameter of the coils that form in succession.

The shaped tube is brought into rotation around the rolling axis by a special control device that normally requires an external motor connected via a transmission system with a bevel gear.

Solutions are known that involve two or more tubes arranged symmetrically in order to balance the centrifugal forces resulting from the high rotation speed of the coil laying head and also to allow a quick replacement of a worn tube.

Also known are solutions that instead of multiple coil laying tubes use a one-piece bell in which a number of passage channels of the rolled product are laid with the appropriate trajectory.

The coil laying tube at the passage of the rolled product is subjected to strong mechanical and thermal stresses, impacts and tangential thrusts that cause particularly serious wear conditions inside the tube and limit its durability.

Frequent replacement of the tube causes downtimes resulting in a reduction of the plant utilization factor and a lack of productivity as well as high costs for spare parts and labor.

This fact precludes the possibility of further increasing the rotation speed of the coil laying head as it would instead be expected by modern rolling mills which are capable of rolling speeds unattainable in the past.

The solution proposed in the patent EP1888267 attempts to overcome these problems by providing two or more coil laying tubes arranged concentrically on one rotor: the tube in operation is used until it is completely worn out after which the new adjacent tube is selected.

The operation for changing the tube in operation takes place through a selector tube placed upstream of the radial system which serves the function of meshing with the rolled product and conveying the same to one of the coil laying tubes of the radial system.

This operation requires a shutdown of the machine and a manual intervention by the operator as explained below.

The selector tube is set in a sleeve which in turn is coaxially inserted in an external containment bushing joined to the tube-holder rotor that is placed in rotation with the bevel gear by an external control motor.

A screw locking system causes the rotational locking between these two coaxial parts when the machine is in motion.

When said parts are unlocked, the sleeve can be made to rotate with respect to the bushing using a worm-screw keyed on one side.

To be able to select a new tube, the machine must be stopped first and the operator, by moving the worm-screw, makes the sleeve of the tube selector turn until the output section is aligned with the input section for the new coil laying tube.

The disadvantages of such a solution are as follows:

- when the machine is in operation, the worm screw turns with it and thus causes an eccentric mass that inevitably causes vibrations;
- changing the pipe in operation requires stopping the machine;
- the change operation must be done manually by an operator, with additional costs.

To resolve and overcome these drawbacks with a simple but extremely effective solution, the Applicant has devised the following invention.

SUMMARY OF THE INVENTION

The main purpose of this invention is to create a multi-tube or multi-conduit coil laying head that has a very long operating life before needing replacement operations and that does not require intermediate stops and/or manual intervention to select the tube or conduit in operation.

Another aim is to make replacement operations very fast requiring a brief stop of the machine.

Another aim is to improve productivity and the system utilization factor to reduce costs for spare parts and labor.

The object of this invention is a coil laying head, conforming to claim 1.

In particular, the coil laying head includes

- a rotor defining a longitudinal axis and comprising two or more conduits and a mandrel having a cylindrical symmetry coaxially connected with the rotor,
- a selector tube coaxially arranged with respect to the rotor configured to guide a rolled product into one of the conduits,
- a main control connected to said mandrel to feed the rotor in rotation
- a phase shifter system having
  - an input component with cylindrical symmetry according to said longitudinal axis and connected with said mandrel
  - an output component with cylindrical symmetry according to said longitudinal axis and connected coaxially with said selector tube,
  - a first nonmoving component with cylindrical symmetry according to said longitudinal axis
  - a second nonmoving component with cylindrical symmetry according to said longitudinal axis
  - a first group of side pinions and
  - a second group of side pinions
  - a second connecting device linking said first group of side pinions with the second group of side pinions to feed it in winding rotation around said longitudinal axis,
  - in which said first group of side pinions is meshed on said input component and on said first nonmoving component in which said second group of side pinions is meshed on said output component and said second nonmoving component,
  - an adjustment device for an angular phase shift between said first and second nonmoving components, so that said angular phase shift adjustment device is nonmoving and so that a phase shift between these nonmoving components causes a proportional angular phase shift between the rotor and the selector tube.

The phase shifter system is made using a differential device having two gearboxes or systems of side pinions meshing respectively on the two different nonmoving components, where it is possible to adjust an angular phase shift, since all the components have cylindrical symmetry and are arranged to rotate around the longitudinal rotation axis of the machine.

In the variants described in detail hereafter, it is preferable that the motion of the main control be transferred to the rotor by the mandrel and that the same mandrel would feed the phase shifter system in rotation. It is completely equivalent to provide that the rotor and the phase shifter system, using independent means for transferring the motion such as gears or pulleys, etc., would be driven in rotation.

In addition, the first input component of the phase shifter system can be advantageously made of a piece with the rotor mandrel.

Dependent claims describe the preferred versions of the invention, forming an integral part of this description.

BRIEF DESCRIPTION OF THE FIGURES

Additional features and advantages of the invention are more evident in light of the detailed description of the preferred but not exclusive, forms of production, of a coil laying head, illustrated by way of example and not exhaustively, with the help of the appended drawings where.

The same reference numbers and letters in the figures identify the same elements or components.

DESCRIPTION IN DETAIL OF A PREFERRED ASSEMBLY OF THE INVENTION

With particular reference to FIGS. 1*a*, 1*b*, 1*c* and 2*a* and 2*b*, the coil laying head that is the subject of this invention is shown schematically as a section in a plane passing through the longitudinal rotation axis X of rotor 14. Other components are omitted as they are not essential to the illustration of the invention.

Figure 1A:
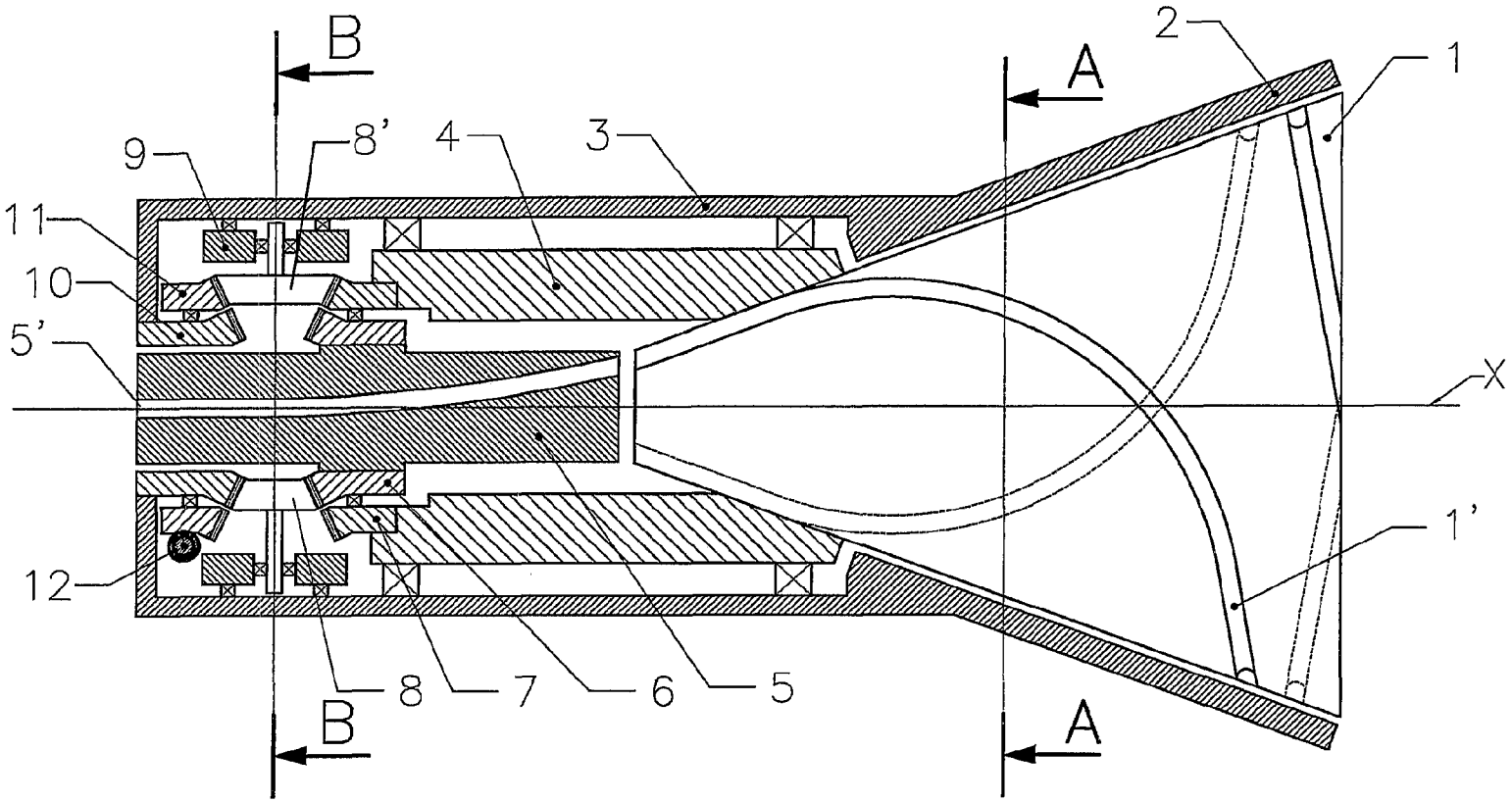
FIG. 1*a* represents a longitudinal section of a coil laying head according to the invention.
Figure 1B:
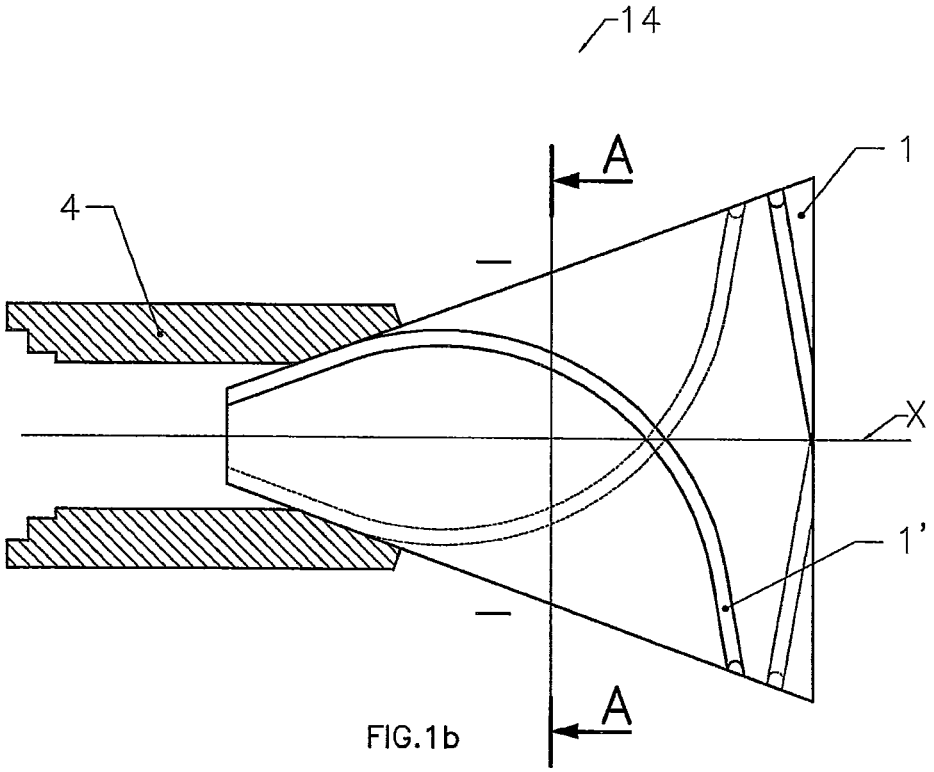
FIG. 1*b* represents a detailed part of FIG. 1.
Figure 1C:
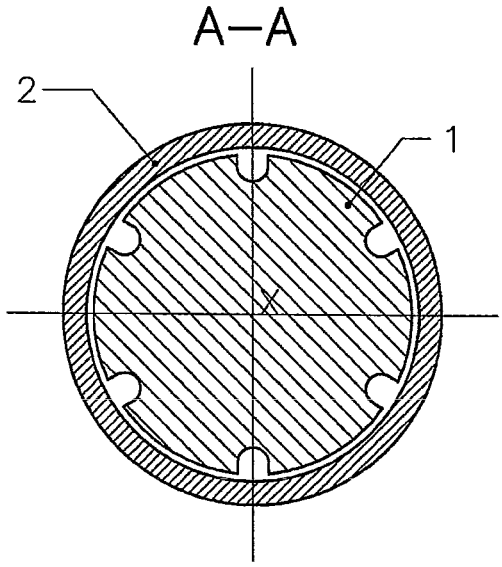
FIG. 1*c* represents a cross-section according to plane A-A of the coil laying head in FIG. 1.

In accordance with a first embodiment shown in FIGS. 1*a* and 1*b*, the head comprises a rotor 14 with cylindrical symmetry and defining the longitudinal rotation axis X of the rotor. The rotor can include a bell 1, preferably in one piece with a truncated conical shape, and a cylindrically formed mandrel 4 connected permanently, using mechanical coupling, the bell 1 according to said axis X.

The bell 1 engages with the mandrel 4 for an initial section, or the bell and mandrel are formed of one piece. The bell 1 is inserted into a housing 2 of a form conjoint with that of the bell, thus in the example, the housing 2 has an internal truncated-conical shape. The housing 2 of bell 1 is joined with the base or casing 3 of the coil laying head and thus is nonmoving, i.e. non-rotating. Between bell 1 and housing 2 a limited clearance is left, for example, of at least 1 mm, in general, sufficient to allow a rotation in relation to bell 1 around the axis X without causing interference or friction against the housing 2. Preferably, this clearance is less than the thickness of the rolled product.

In accordance with a preferred variant, the housing 2 of the bell 1 can be opened to allow access to the bell 1.

In accordance with another variant, the housing 2 of bell 1 can be slid axially along X with respect to bell 1 to enable varying the gap between the housing of the bell and the bell itself.

The bell 1 has a multiplicity of grooves or channels 1' on its outer surface, of which FIGS. 1*a* and 1*b* show only two, of which one is visible in transparency, for reasons of clarity. In the section along the plane A-A illustrated by FIG. 1*c* the grooves 1' are instead represented for this case in an assembly form with six grooves arranged symmetrically along the surface of the bell and having an equal depth and shape. The channels 1' are open to the outside and have a cross-section dimension which is a function of the diameter of the rolled product to be wound in spiral. The mandrel 4 turns inside a casing 3 fixed to the ground, to which mandrel 4 is rotationally linked by bearings. The casing 3 can be entirely one piece with the housing 2 of bell 1.

Figure 2A:
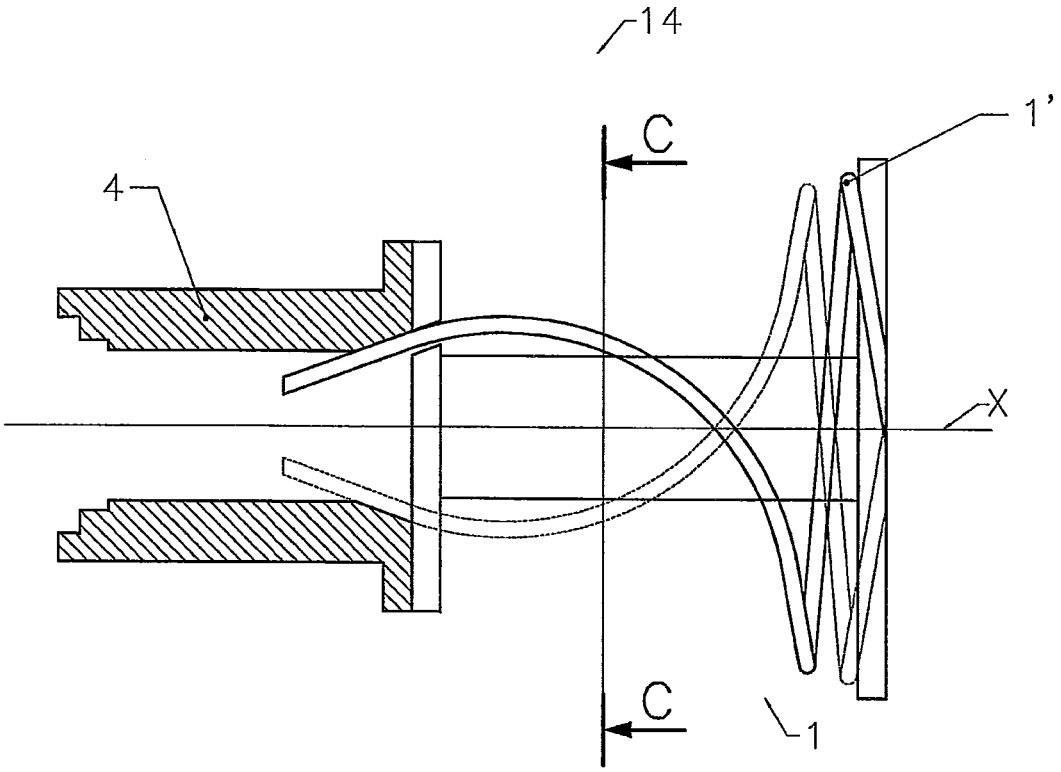
FIG. 2*a* represents a longitudinal section of a variant of a detailed part represented in FIG. 1 *b,*
Figure 2B:
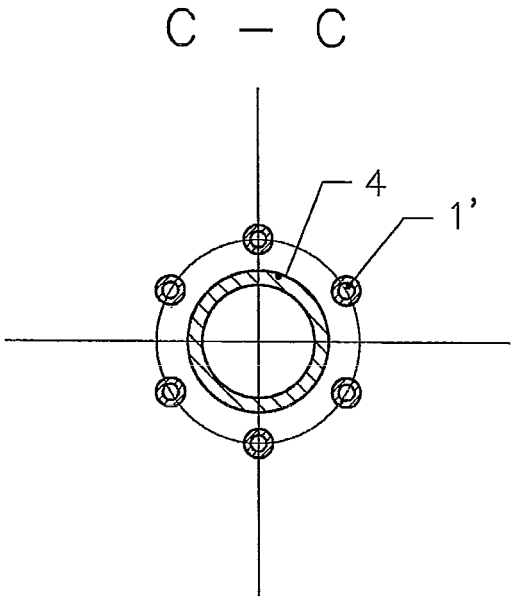
FIG. 2*b* represents a cross section according to the plane C-C of the coil laying head of FIG. 2*a,*

In accordance with a second form of assembly shown in FIGS. 2*a* and 2*b*, the rotor 14 comprises a multiplicity of shaped coil laying tubes 1' arranged concentrically and possibly kept in position by additional elements not shown. The skilled person is capable of identifying equivalent and alternative solutions to guide the rolled product within the conduits of whatever shape or make for the purpose of forming coils using the rotation of the rotor 14.

Upstream, in the direction of the rolled product's insertion into the head and of the rotor cooperating with it there is a selector tube 5 with an internal conduit 5' having an input section to admit the rolled product, which enters into the head in a direction coaxial to the axis X. This internal conduit 5' has an output section that diverges from the axis X to guide the rolled product from the input direction into one of the channels 1' or the formed tubes.

A main control, not shown, transmits a torque drive to mandrel 4 which induces the rotation of the rotor 14 around the axis X, for example through a speed reducer or an equivalent device.

The selector tube 5 always rotates synchronously with the rotor 14 and the mandrel 4 during the transit of the rolled product and preferably receives the motion of the same mandrel 4, through a phase shifter r system.

This phase shifter system includes

- a first bevel gear 7, annular, coaxial with the axis X and joined or of one piece with mandrel 4,
- a second bevel gear 6, annular, coaxial with the axis X, that would, preferably, be at least partially arranged inside the first gear 7 with suitable interposed bearings and joined or of one piece with selector tube 5,
- a side pinion carrier cradle 9, also called a side pinion holder case, comprising two groups of side pinions 8 and 8' with respective shafts perpendicular to the axis X, rotationally coupled to the cradle which supports them in winding rotation around the axis X; a group of side pinions 8' meshes in the first bevel gear 7 and the other 8 meshes in the second bevel gear 6; the side pinion carrier cradle 9 is also coaxial with the axis X and supported in free rotation by the casing 3 using the appropriate bearings,
- a third bevel gear 11, annular, coaxial with the axis X and joined with casing 3 by means of the angular phase shift adjuster 12; the third gear meshes with the groups of side pinions 8' relating to the first bevel gear 7, a fourth bevel gear 10, annular, coaxial with the axis X, arranged, preferably, at least partially inside the first gear 11 with appropriate bearings interposed and joined or of one piece with the casing 3; the fourth gear meshes with the group of side pinions 8 related to the second bevel gear 6.

The mandrel 4 drives the first gear 7 which thus defines the only part of the phase shifter system that transmits motion to side pinion 8', which rotates around its own shaft. The side pinion 8', meshing on the third gear 11, which is normally nonmoving, rotates the cradle 9 to which the same side pinion is rotationally linked. The side pinion 8, driven by the cradle 9, meshes in the fourth gear 10 which is permanently nonmoving, so that the side pinion 8 is caused to rotate around its own axis by transferring the motion to the second bevel gear 6, which rotates the pipe selector 5, joined thereto. By normally nonmoving is meant that the gear 11 is fixed with respect to the casing 3 with the exception of when the adjustment device 12 operates a phase shift of the same gear 11 with respect to the gear 10, which is permanently connected to the casing. The ratios are dimensioned so that the angular speed of the selector tube 5 and the rotor 14 are normally synchronous, so as to ensure continuous alignment between the output section of the internal conduit 5' of the selector tube 5 and one of the channels 1' during the passage of the material.

By changing the angular position of the third gear 11 with respect to the fourth gear 10, using said angular adjustment device 12, the second gear 6 gains or loses a proportional phase shift angle relative to the rotor 14, during the rotation thereof. As the second gear 6 is joined with the selector tube, it achieves what is desired, namely a controllable angular phase shift between the selector tube and the rotor 14. Advantageously, the angular adjustment device 12 is joined to the casing 3, solving the above mentioned problem.

Figure 8:
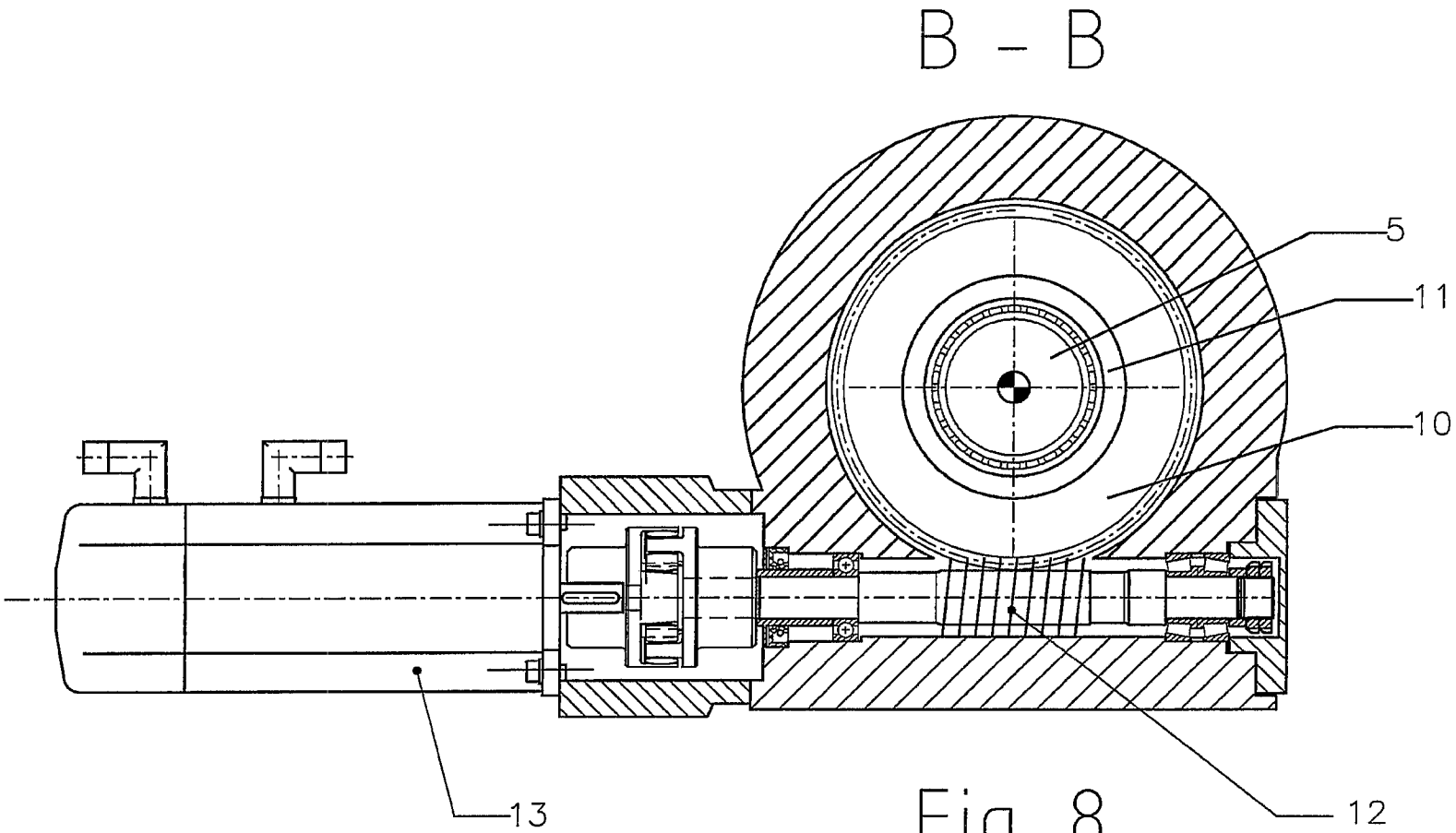
FIG. 8 represents a cross section according to plane B-B of the coil laying head of FIG. 1. For greater ease of reading, the bearings visible in FIG. 1 are represented by an X enclosed in a rectangle.

In particular, this angular adjustment device 12 can be made using a worm screw keyed between the two nonmoving gears 10 and 11 and activated automatically by a rotary servocontrol as shown in FIG. 8 or by using a linear control device, for example, a pneumatic or hydraulic piston connected between the two nonmoving gears. The angular adjustment device 12 can be controlled advantageously by the same motion control system of the rolled product, so as to make the selection of the conduit 1' between the end of the operation of one metal wire and the entry of another.

Therefore, this system of selecting the conduit 1' is made using a phase shifter system, which transfers the rotating motion to the selector tube 5 so that it rotates synchronously with the rotor, in which the phase shifter system has two nonmoving components 10 and 11 which can be controlled by one reciprocal angular phase shifter around the longitudinal axis X.

Component 7 defines the input of the phase shifter system, while component 6 and therefore selector tube 5 represents the output of the phase shifter system. One of the two side pinion systems meshes on the output component and on one of the nonmoving components, the other of the two side pinions groups is meshed on the input component and the other of the nonmoving components. It is possible to control an angular phase shift between the two nonmoving components, which translates into an angular phase shift between the selector tube and the rotor. It is therefore the same thing to permanently bind gear 10 or gear 11 to the casing 3. This also applies to the variants described below.

This invention allows, therefore, concretely and automatically achieving the selection of a conduit 1' without stopping the rotation of the rotor and the selector tube.

Figure 3:
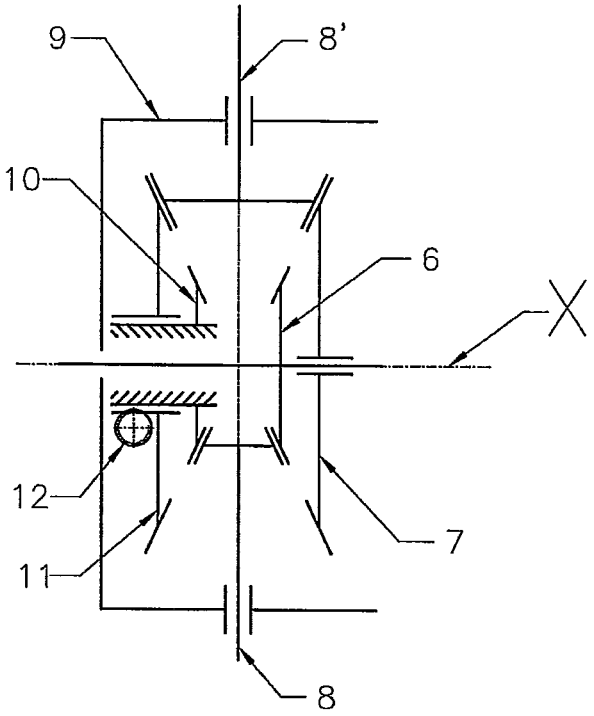
FIG. 3 is a kinematic scheme equivalent to the head in FIG. 1.

FIG. 3 shows the kinematic scheme of the phase shifter system of FIG. 1. The same system can also be produced in variable configurations as represented in FIGS. 4, 5, 6 and 7, which are equivalent, presenting equivalent kinematic laws obtained through planetary rephasers with axes parallel or perpendicular with respect to the axis X, by means of gears, presumably cylindrical, or bevel gears.

Figure 4:
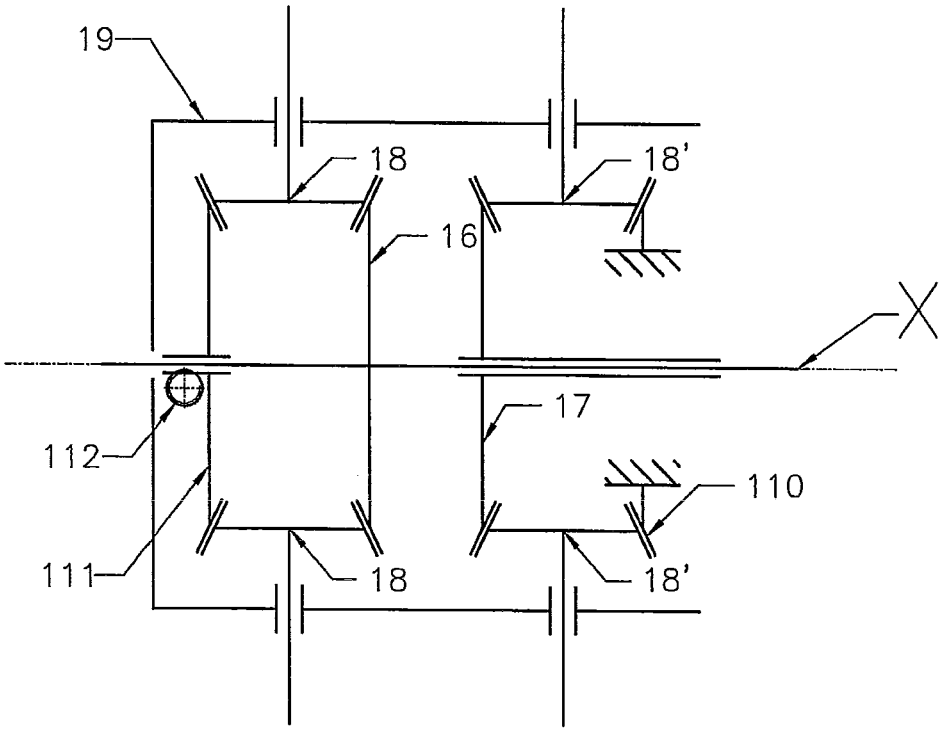
FIGS. 4, 5, 6 and 7 are kinematic schemes equivalent to variants of the coil laying head according to FIGS. 1 and 3.

In the variant of FIG. 4, the first bevel gear 17 receives the main control motion of the head, not shown, and meshing on the side pinions 18', transfers the rotary motion to the side pinion carrier cradle 19, since the side pinions 18' also mesh on a fourth nonmoving wheel 110. The side pinion carrier cradle goes to a first pair of side pinions 18' and a second pair of side pinions 18, with the two shafts of the pairs lying on separate parallel planes and perpendicular to the axis X, and with the same shafts perpendicular with respect to the axis X.

The side pinions 18, driven by the cradle 19, mesh on a third gear 111 which is rotationally linked to the casing 3 by means of angular adjustment 112, for which reason it is normally nonmoving. The side pinions 18 are therefore compelled to rotate around their respective shafts, transferring the motion to the second bevel gear 16 that is joined/of one piece with selector tube 5, not shown.

In this embodiment, like in the following embodiments, the number of side pinions is doubled. In reality, only one of the side pinions 18' of the first pair and only one of the side pinions 18 of the second pair suffices for all purposes, but since their respective shafts are not mutually coaxial, as in the first variant, it is preferable to balance the forces by using the other two side pinions respectively. It turns out, therefore, that the shafts of the first side pinions 18' lie on one plane, the shafts of the second side pinions 18 lie on a second parallel plane separate from the first plane, and both planes are perpendicular to the axis X.

Figure 5:
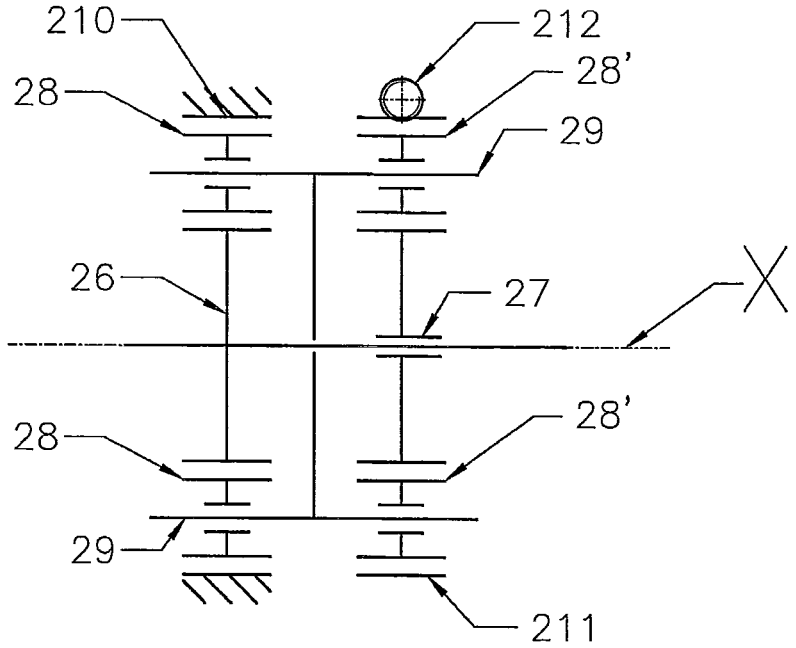

In the embodiment represented in FIG. 5, the differential system is epicyclic and the first gear 27 with external gearing receives the motion from the main control, not shown, and transmits it to the side pinions 28', that have shafts parallel to each other and to the axis X. The side pinions 28', meshing on the third gear 211, a crown with internal gearing, usually nonmoving, turn around their own shaft, driving the cradle 29 in rotation around the axis X.

The cradle 29 includes second side pinions 28 with axes parallel to each other and to the axis X, which mesh externally on the fourth gear 210, a crown with internal gearing, permanently nonmoving and internally meshed on the second gear 26, with external gearing, joined with the selector tube 5.

As the crown 210 is permanently nonmoving, the second side pinions 28 set gear 26 in rotation, which is synchronous with respect to the first sprocket 27 that is joined with the rotor 14. Therefore it turns out, yet once more, that the selector tube 5 and the rotor 14 are in synchronous rotation around the axis X.

Any rotation of the third gear 211 by effect of the rotation of the worm screw 212 that meshes with it, causes a phase shift of a certain angle both between the nonmoving gears 210 and 211, and between the gears 26 and 27, causing a phase shift between the selector tube 5 and rotor 14.

Figure 6:
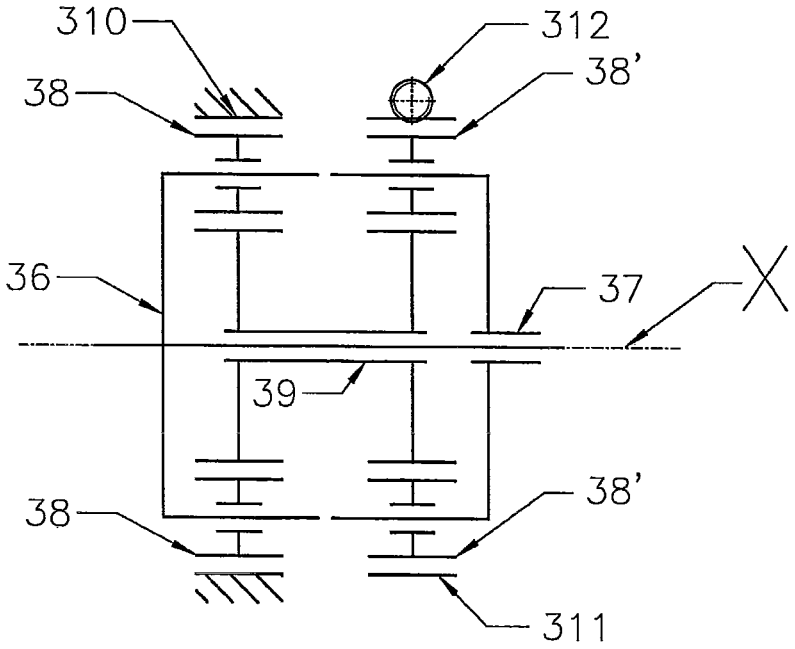

In the variant of FIG. 6 the differential system is epicyclic and component 37 is a first cradle which goes to the first side pinions 38', having axes parallel to each other and to the axis X. This first cradle receives the motion from the main control of the head, not shown, rotating the first side pinions 38'.

The first side pinions 38' mesh externally on the third gear 311, a crown with internal gearing, normally nonmoving and meshing internally on a first pair of twin sprockets 39. When the cradle 37 is placed in rotation, the first side pinions 38', meshing in the third gear 311, normally nonmoving, drive the pair of twin gears 39 in rotation.

A second pair of side pinions 38, with axes parallel to each other and to the axis X, is carried by a second cradle 36. These mesh internally on a second of said pair of twin gears 39 and externally on a fourth gear 310, a crown with internal gearing nonmoving permanently.

By which the second side pinions 38 revolve around both their own shaft and around the axis X and the second side pinions cradle 36 rotates synchronously with respect to the first side pinions carrier 37.

The side pinions carrier 36 is connected with the selector tube 5, not shown, which therefore rotates synchronously with the rotor 14. An angular phase shift between the gears 310 and 311 by device 312 causes a proportional angular phase shift between the two side pinions carriers 36 and 37 and therefore between the selector tube 5 and the rotor 14.

Figure 7:
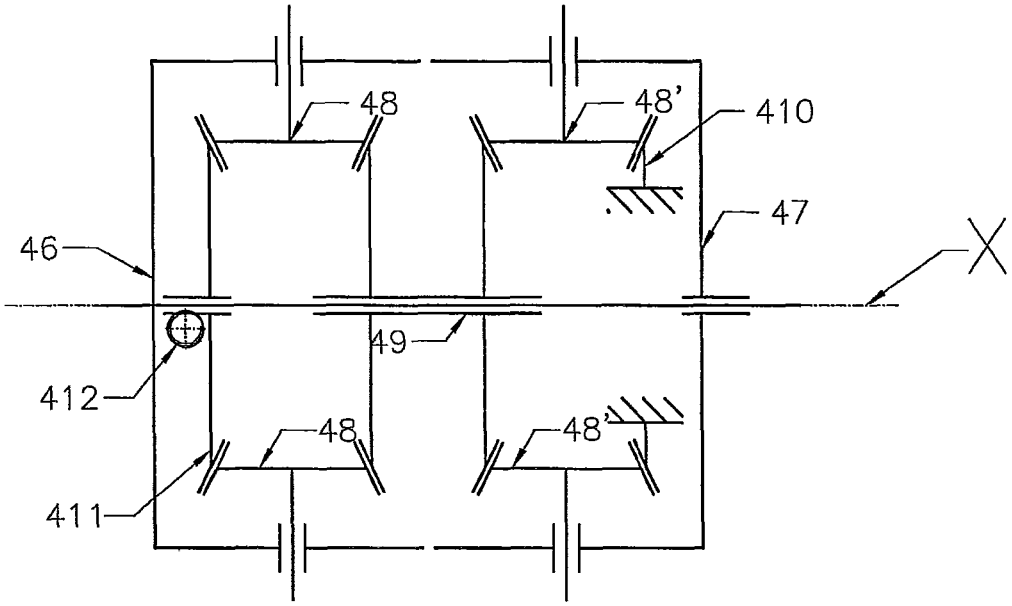

In the variant of FIG. 7, component 47, as for the preceding variant, is a first cradle that goes to a first pair of side pinions 48', with their respective axes perpendicular to the axis X. The component 47 receives the motion by the main control, not shown.

The first side pinions 48' mesh both on a fourth gear 410, a bevel crown permanently nonmoving, and on a first of a pair of twin bevel gears 49, that is thus driven in rotation by the first side pinions 48'.

The second of the pair of twin bevel gears 49 meshes on a second pair of side pinions 48, with shafts perpendicular to the axis X, which are carried by a second cradle 46 joined with the selector tube, not shown.

The second side pinions 48 also mesh on a third gear 411, a geared crown normally nonmoving whose angular phase shift with respect to the fourth gear 410 is adjustable by means of an angular adjustment device 412.

Also in this case, an angular phase shift between the third 411 and fourth gear 410 causes a proportional phase shift between the second cradle 46 and the first cradle 47, which is joined to the rotor 14 and thus a phase shift between the selector drum 5 and the rotor 14.

In all the variants, the side pinion carrier cradle or cradles turn out to be rotationally linked with the head in accordance with the axis X.

The advantages provided by the coil laying machine according to the invention are as follows:

The selection of the conduit in operation of the rotor (variation in phase) occurs in the absence of the rolled product inside the machine, for example, during the time elapsing from the output of the tail of a bar next to the input of the subsequent head (dead time or inter-billet), without the need to stop the motion of the machine.

Phase variation can in any case also take place with the machine stopped.

Phase variation takes place automatically via an auxiliary control, so this operation does not require any manual intervention.

Switching between the conduits can be done using any criterion (clockwise, counter-clockwise, in sequence or at random) and at any time, not necessarily when a conduit is worn.

Aligning the selector tube with respect to a conduit of the rotor and maintaining it in position during the transit of the rolled product takes place via an angular control device applied to the auxiliary control.

The related locking between the selector tube and the rotor is guaranteed by the non-reversibility of the gear train.

The synchronising of movement between the selector tube and the rotor is guaranteed by a system of mechanical transmission (the mandrel) without the use of external controls, with considerable simplification and reliability.

The lubrication of the rotating parts of the phaser unit can be independent or derived from a multi-conduit machine.

The solution with bevel gear train illustrated in FIGS. 1*a* and 3 is the one that optimizes the dimensions.

In FIG. 8, the BB plane crosses the head in correspondence to the worm screw 12. The same figure shows the secondary control 13, connected by its axis to the worm screw 12, so as to control the reciprocal movement of gears 10 and 11.

Advantageously, the secondary control 13 is joined with the casing 3.

The elements and features shown in the various forms of preferred assembly can be combined among themselves without thereby eluding the scope of protection of this application.

The invention claimed is:

1. A coil laying head comprising a rotor defining a longitudinal rotation axis and comprising two or more conduits and a mandrel having a cylindrical symmetry according to said longitudinal axis, a selector tube, coaxially arranged with respect to the rotor, configured to guide a rolled product into one of the conduits, a main control connected to said mandrel to feed the rotor in rotation, a phase shifter system having gears comprising two nonmoving components with respect to a base, an input component coaxially connected to the mandrel to receive the rotary motion thereof, an output component connected to the selector tube, a first group of side pinions engaging on the input component and on one of the nonmoving components, and a second group of side pinions engaging on the output component and on the other of the nonmoving components, connecting means for connecting said first group of side pinions with said second group of side pinions to feed them in rotation according to said longitudinal axis, adjusting means for adjusting an angular phase shift between said two nonmoving components.

2. A coil laying head according to claim 1, wherein respective shafts of said first or second group of side pinions are parallel or transversal with respect to said longitudinal axis.

3. A coil laying had according to claim 1, wherein said input component comprises a first bevel crown, said output component comprises a second bevel crown, said first group of side pinions comprises a first bevel side pinion, said second group of side pinions comprises a second bevel side pinion and respective shafts of the side pinions are coaxial to one another and transversal with respect to said longitudinal axis, said connecting means comprise a side pinion carrier, which is common to said first and second groups of side pinions, a first nonmoving component of said two nonmoving components comprises a third bevel crown and a second nonmoving component of said two nonmoving components comprises a fourth bevel crown.

4. A coil laying head according to claim 3, wherein said second bevel crown is at least partially inserted into and pivotally associated with said first bevel crown and wherein said fourth bevel crown is at least partially inserted into and pivotally associated with said third bevel crown.

5. A coil laying head according to claim 1, wherein said input component cornprises a first bevel crown, said output component comprises a second bevel crown, said first group of side pinions comprises a first pair of bevel side pinions having respective shafts which are coaxial to each other and resting on a first plane transversal to said longitudinal axis, said second group of side pinions comprises a second pair of bevel side pinions having respective shafts which are coaxial to each other and resting on a second plane transversal to said longitudinal axis, which is different from said first plane, said connecting means comprise a side pinion carrier, which is common to said first and second groups of side pinions.

6. A coil laying head according to claim 1, wherein said input component comprises a first crown, said output component comprises a second crown, said first group of side pinions comprises a first pair of side pinions having respective shafts which are parallel to each other and parallel with respect to said longitudinal axis, said second group of side pinions comprises a second pair of side pinions having respective shafts which are parallel to each other and parallel with respect to said longitudinal axis, said connecting means comprise a side pinions carrier, which is common to said first and second groups of side pinions.

7. A coil laying head according to claim 1, wherein said input component comprises a first side pinions carrier supporting said first group of side pinions having respective shafts which are parallel to one another and parallel with respect to said longitudinal axis, said output component comprises a second side pinions carrier supporting said first group of side pinions having respective shafts which are parallel to one another and parallel with respect to said longitudinal axis, said connecting means comprise a pair of twinned gears, a first one of which is engaged by said first group of side pinions and a second one is engaged by said second group of side pinions.

8. A coil laying head according to claim 1, wherein said input component comprises a first side pinions carrier supporting said first group of bevel side pinions, having respective shafts which are coaxial to one another and transversal with respect to said longitudinal axis, said output component comprises a second side pinions carrier supporting said second group of bevel side pinions, having respective shafts winch are coaxial to one another and transversal with respect to said longitudinal axis, said connecting means comprise a pair of twinned, bevel gears, a first one of which is engaged by said first group of side pinions and a second one is engaged by said second group of side pinions.

9. A coil laying head according to claim 1, wherein the adjusting means comprise a worm screw keyed between a first of said two nonmoving components and a second of said two nonmoving components or an in line servo-control connected between a first of said two nonmoving components and a second of said two nonmoving components.

10. A coil laying head according to one of the preceding claims, wherein said rotor comprises a truncated-conical bell wherein said two or more conduits are defined by respective grooves on the outer surface of the bell or two or more shaped tubes radially arranged and respectively defining said two or more conduits.

* * * * *